US007343988B2

(12) United States Patent
Jamieson

(10) Patent No.: US 7,343,988 B2
(45) Date of Patent: Mar. 18, 2008

(54) DRILLING APPARATUS

(75) Inventor: Angus Jamieson, Iverness (GB)

(73) Assignee: Technology Ventures International Ltd, Aberdeen (GB)

( * ) Notice: Subject to any disclaimer, the term of this patent is extended or adjusted under 35 U.S.C. 154(b) by 317 days.

(21) Appl. No.: 10/516,439

(22) PCT Filed: May 28, 2003

(86) PCT No.: PCT/GB03/02319

§ 371 (c)(1),
(2), (4) Date: Jun. 7, 2005

(87) PCT Pub. No.: WO03/102353

PCT Pub. Date: Dec. 11, 2003

(65) Prior Publication Data

US 2005/0247489 A1 Nov. 10, 2005

(30) Foreign Application Priority Data

May 30, 2002 (GB) ..... 0212553.2
Aug. 2, 2002 (GB) ..... 0218033.9

(51) Int. Cl.
*E21B 7/28* (2006.01)

(52) U.S. Cl. ..... 175/263; 175/61

(58) Field of Classification Search ..... 175/61, 175/74

See application file for complete search history.

(56) References Cited

U.S. PATENT DOCUMENTS

| | | | | |
|---|---|---|---|---|
| 5,957,222 | A | 9/1999 | Webb et al. | |
| 6,082,470 | A | 7/2000 | Webb et al. | |
| 6,364,037 | B1 * | 4/2002 | Brunnert et al. | 175/61 |
| 6,401,842 | B2 | 6/2002 | Webb et al. | |
| 6,702,046 | B2 | 3/2004 | Webb et al. | |
| 6,892,830 | B2 * | 5/2005 | Noe et al. | 175/61 |

* cited by examiner

*Primary Examiner*—Frank Tsay
(74) *Attorney, Agent, or Firm*—Frank J. Dykas; Stephen M. Nipper; Dykas, Shaver & Nipper, LLP

(57) ABSTRACT

A drilling apparatus for drilling a deviated bore comprising a tubular outer member having an offset and adapted for rotatably supporting a drill bit. The member has a gripping arrangement for selectively engaging the wall of a bore to restrain the member against rotation. An inner member is provided within the outer member for coupling to the drill bit at one end and to a drill string at another end. The apparatus has a first configuration in which the gripping arrangement is retracted and the inner member is coupled to the outer member such that rotation of the drill string provides for corresponding rotation of the inner and outer members, and a second configuration in which the gripping arrangement is extended and the inner member is rotatable relative to the outer member such that the outer member is restrained from rotation in the bore and rotation of the drill string provides for corresponding rotation of the inner member and the drill bit.

25 Claims, 5 Drawing Sheets

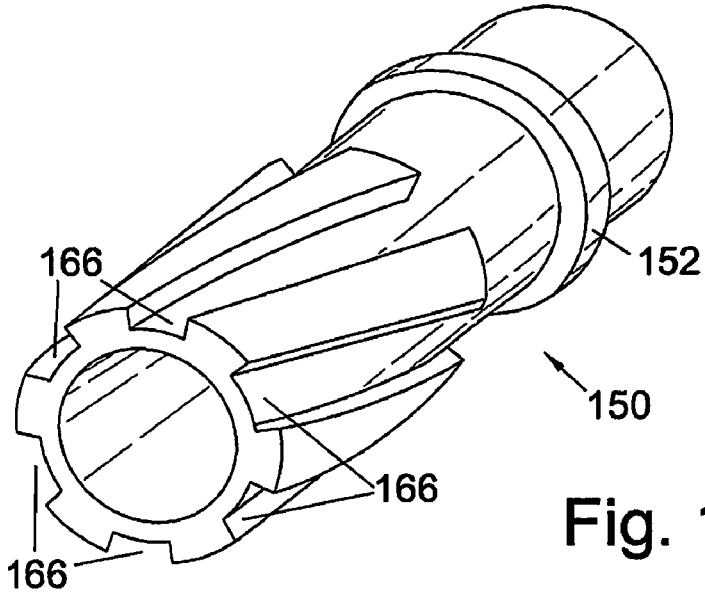
Fig. 11
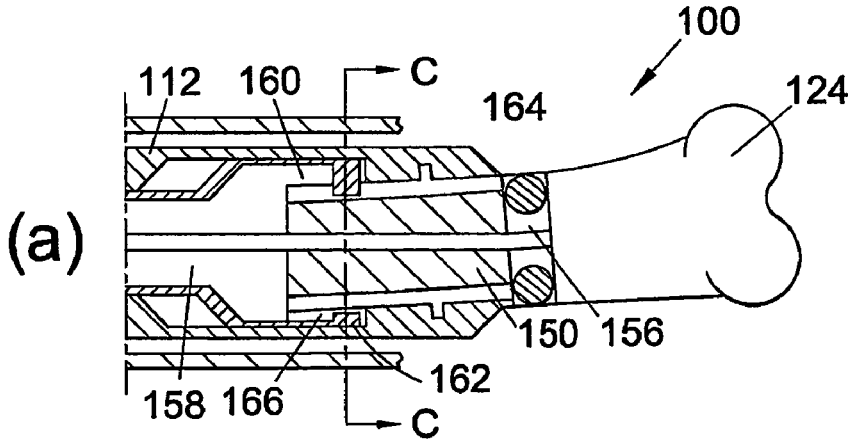
Fig. 12
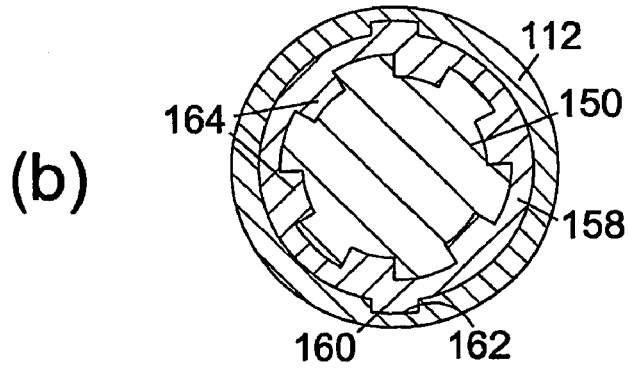

DRILLING APPARATUS

FIELD OF INVENTION

The present invention relates to a drilling apparatus, and in particular to a drilling apparatus for drilling deviated bores, particularly, but not exclusively, for intersecting a subterranean hydrocarbon formation.

BACKGROUND OF INVENTION

In the oil and gas extraction industry, hydrocarbons are extracted from a subterranean formation through bores which are drilled from surface level to intersect the formation. In many circumstances, a number of vertical bores are required for efficient and effective extraction of hydrocarbons from a single formation, which often necessitates a corresponding number of surface drilling locations, which can be undesirable, particularly in offshore drilling operations. Methods, however, exist which allow non-vertical bores to be drilled permitting a wide area to be accessed from a single surface drilling location. Such methods are commonly referred to as directional or controlled trajectory drilling.

During directional drilling operations, a curved or deviated bore may be drilled by placing a slight bend in the drilling assembly, referred to as a bent sub assembly, and orientating the bend in the required direction. For example, if the bend points upwards, the well bore will gain inclination angle. Likewise, if the bend points downwards, the well will drop angle and tend to return to a vertical plane. If the bend is used to point the drill bit left or right, the well bore will change direction accordingly to the left or right.

Rotation of the drill bit is normally achieved by rotating the drill string from surface level. When a bent sub assembly is present, the rotation of the whole drill string negates the effect of the bent sub assembly.

However, it is conventional to drive the drill bit during directional drilling using a downhole positive displacement mud motor which normally comprises a long section of internally "twisted" pipe with a similarly twisted rotor positioned therein. The flow of drilling fluid through the twisted section will turn the rotor which is connected to the drill bit by a flexible steel rod which passes through the bent sub assembly. In this way, the drill bit is turned without the bent sub assembly rotating and without the requirement for the whole drill pipe to be rotated from the surface.

However, when the bit makes contact with the rock face at the bottom of the bore, the torque generated by the mud motor has an equal and opposite reactive torque which will cause the drill string to twist or rotate back to surface level. The twist is normally significant and makes control of the angle at which the bent sub points the drill bit difficult to set and maintain.

Furthermore, when the drill string is not rotated, a situation known as "stick slip" occurs which can potentially damage the tooling. Stick slip occurs because the weight applied to a stationary drill string to advance a drill bit has to overcome static friction between the drill string and the bore wall; the non-rotating string tends to stick in the bore, such that weight or force has to be applied to move the string forward. The string will then often "unstick" suddenly, and slip forward, forcing the drill bit into the end of the bore and often stalling the mud motor. It is therefore preferred that the drill string also be rotated during all drilling operations such that a lower, dynamic friction has to be overcome, allowing for smoother drilling.

It is known to provide directional drilling while rotating the entire drill assembly ("rotary directional drilling"), however, this requires additional and sometimes complicated and expensive downhole assemblies to maintain the bent sub in its desired orientation.

During directional drilling, it is essential that the direction in which the bent sub is pointing is known at all times, to ensure that the bore is being drilled in the correct direction and that adjustment to the orientation of the bent sub may be made as soon as an error is detected. In previously proposed rotary directional drilling systems, such monitoring is commonly achieved using dedicated complex electrical systems which are provided in addition to the Measurement-While-Drilling (MWD) systems already provided within the bottom hole drilling assembly (BHA), thus increasing the complexity and expense of monitoring equipment which must be provided.

It is among the objectives of the embodiments of the present invention to provide directional drilling apparatus which obviates, or at least mitigates the aforementioned problems with the prior art.

SUMMARY OF INVENTION

According to a first aspect of the present invention, there is provided a drilling apparatus for drilling a deviated bore, said apparatus comprising:

a tubular outer member having an offset and for rotatably supporting a drill bit, the member having gripping means for selectively engaging the wall of a bore to restrain the member against rotation;

an inner member within the outer member and for coupling to the drill bit at one end and to a drill string at another end;

wherein the apparatus has a first configuration in which the gripping means is retracted and the inner member is coupled to the outer member such that rotation of the drill string provides for corresponding rotation of the inner and outer members, and a second configuration in which the gripping means is extended and the inner member is rotatable relative to the outer member such that the outer member is restrained from rotation in the bore and rotation of the drill string provides for corresponding rotation of the inner member and the drill bit.

Thus, with the apparatus in the first configuration, the offset of the outer tubular member may be rotated to a required orientation, which orientation may then be maintained by reconfiguring the apparatus such that the outer member, including the offset, is then restrained from further rotational motion. In the second configuration, the offset drill bit is rotated by the drill string, that is the offset drill bit is driven from surface, thus obviating the need to provide a separate downhole motor, and avoiding the difficulties that arise when attempting to drill without rotation of the drill string.

Conveniently, the inner member may be moved in at least one of axially and rotatably relative to the outer member to reconfigure the apparatus.

Preferably, the inner member includes an elongate drive member, such as a drive rod, which extends through at least a portion of the outer member. An upper portion of the inner member may be adapted for coupling to the drill string, with a lower portion of the inner member adapted for coupling to the drill bit, the elongate drive member rotatably coupling the lower portion of the inner member and the drill bit.

Preferably, the drive member is flexible, to accommodate different relative orientations of the offset. Preferably also, the drive member is axially moveable relative to at least one of the lower portion of the inner member and the drill bit. The drive member and said at least one of the lower portion of the inner member and the drill bit preferably define a cooperating profile to provide rotational coupling while permitting relative axial movement. For example, the drive member may have a hexagonal section, and the lower portion of the inner member or the drill bit defines a cooperating hexagonal bore or bush.

Preferably, the inner member is coupled to the outer member by engagement of at least one pin mounted on one of the inner and outer members, with at least one complementary profiled path in the other of said inner and outer members. More preferably, the inner member is coupled to the outer member by engagement of at least one pin on the outer surface of the inner member with at least one complementary profiled path or track on an inner surface of the outer member. In a preferred embodiment, a plurality of pins are provided on the inner member which respectively engage complementary profiled paths in the outer member. Thus, by moving the inner member relative to the outer member, the at least one pin may be moved within the corresponding profiled path in order to reconfigure the drilling apparatus.

Preferably, the apparatus is arranged such that, in the first configuration, the relative rotational orientation of the inner and outer members is known. This may be achieved by any appropriate mechanism, for example when pins or followers on one member engage paths or tracks on the other member, these may be arranged such that the pins or followers will only engage with a selected track or groove. In a preferred embodiment, one of the pins or followers may be longer than the others, and only a selected one of the paths or tracks may have a lead-in which will accommodate the longer pin.

This preferred arrangement offers the advantage that, in the first configuration, the relative orientation of the outer member, and its offset, to the inner member, and thus to the drill string, and the associated bottom hole assembly (BHA), will always be the same. As the BHA conventionally includes MWD apparatus, this existing MWD apparatus may be utilised to determine to orientation of the offset. Thus, the apparatus does not require the provision of dedicated MWD apparatus, or other orientation sensors, with a considerable saving in the costs of producing, using and maintaining the apparatus.

Preferably, in a third configuration, with weight applied to the apparatus, the gripping means is retracted and the inner member is coupled to the outer member such that rotation of the drill string provides for corresponding rotation of the inner and outer members, and the drill bit. The third configuration may thus be utilised for rotary drilling with the offset rotating with the drill string and thus its directional effect negated.

Preferably, the first configuration may be attained when the apparatus is lifted off bottom.

Preferably, the second configuration is attained with weight applied to the apparatus.

Preferably, the apparatus is adapted to move between configurations sequentially, in response to the application and lifting of weight to and from the apparatus. In a preferred embodiment, the apparatus may be cycled from the first configuration, to the second configuration, to the third configuration, and then to the first configuration.

The gripping means may take any appropriate form. Preferably, the gripping means are weight actuated, that is the gripping means extend and retract in response to weight being applied to or lifted from the apparatus. The gripping means may comprise radially movable members which engage movable cams or the like, but preferably comprise axially extending members which buckle or bow outwards on compression thereof. The members may carry ridges, teeth, or other profiles adapted to grip the bore wail to prevent rotation but to permit axial sliding. In other embodiments the gripping means may be fluid pressure actuated. Preferably, the gripping means is biased towards the retracted position.

Preferably, the apparatus includes a bearing between the inner and outer members such that, in the second configuration, weight may be applied to the drill bit from the drill string via the inner and outer members while the inner member and drill bit rotate relative to the outer member.

According to a second aspect of the present invention, there is provided a drilling apparatus for drilling a deviated bore, said apparatus comprising:

a tubular outer member having gripping means for selectively engaging the wall of a bore to restrain the member against rotation and including an offset portion for rotatably supporting a drill bit;

an inner member located within the outer member and for coupling to the drill bit at one end and to a drill string at another end;

wherein the apparatus has a first configuration in which the gripping means is retracted and the inner member is coupled to the outer member such that rotation of the drill string provides for corresponding rotation of the inner and outer members, and a second configuration in which the gripping means is extended and the inner member is rotatable relative to the outer member such that the outer member is restrained from rotation in the bore and rotation of the drill string provides for corresponding rotation of the inner member and the drill bit.

Conveniently, the inner member may be moved in at least one of axially and rotatably relative to the outer member to reconfigure the apparatus.

Preferably, the offset portion is rotatably mounted within a portion of the outer member and is rotatable relative thereto between a first position and a second position. Conveniently, the offset portion is axially fixed relative to said portion of the outer member.

In a preferred embodiment, rotation of the offset portion between said first and second positions occurs in response to axial movement of the inner member with respect to said portion of the outer member.

Conveniently, the offset portion has an axis of rotation disposed at an angle from an axis of rotation of said portion of the outer member.

Preferably, the drill bit is rotatably located relative to a lower end face of the offset portion, which lower end face is inclined from a lateral axis of the offset portion such that, in the first rotational position, the inclination of the end face is negated by the angle of offset of the axis of rotation, resulting in the end face of the offset portion being positioned substantially parallel to an end face of said portion of the outer member. On the other hand, in the second rotational position, the effect of the inclination of the end face in combination with the angle of offset results in the end face of the offset portion being inclined relative to the end face of said portion of the outer member. Thus, when the offset portion is in a first rotational position, the drill bit will be coaxially aligned with said portion of the outer member, and when the offset portion is in a second position, the drill bit will be coaxially misaligned or offset.

Preferably, in the first configuration of the apparatus, the drill bit is coaxially aligned with said portion of the outer member, and in the second configuration, the drill bit is coaxially misaligned or offset.

Thus, with the apparatus in the first configuration, the outer member may be rotated to locate the offset portion in a predetermined orientation. The drill bit may then be offset by rotation of the offset portion relative to said portion of the outer member, and the offset maintained by reconfiguring the apparatus such that the outer member, including the offset portion, is then restrained from further rotational motion. In the second configuration, the offset drill bit may be rotated by the drill string, that is the offset drill bit is driven from surface, thus obviating the need to provide a separate downhole motor, and avoiding the difficulties that arise when attempting to drill without rotation of the drill string.

Preferably, rotation of the offset portion relative to said portion of the outer member is provided by at least one helical channel or track located on the outer surface of the offset portion interacting with a respective rotationally fixed pin which is received within said at least one channel. Thus axial movement of the rotationally fixed pin will cause rotational motion of the offset portion, which offset portion, as noted above, is preferably fixed in an axial position relative to said portion of the outer member. Preferably, a plurality of helical channels are provided, and each interact with a respective pin.

The at least one channel or track may be formed in the surface of the offset portion, or alternatively may be defined by fixing elongate members to the outer surface of the offset portion. The elongate members may be fixed in place, for example, by bolting, screwing or welding or the like.

In a preferred embodiment, each rotationally fixed pin is provided on an inner surface of an intermediate tubular member which is located within the outer member, between the inner member and offset portion. Conveniently, the intermediate member is axially moveable and rotationally fixed with respect to the outer member by, for example, a longitudinal sliding key and key-way arrangement. Thus, when the intermediate member is moved in an axial direction, the intermediate member will move over the offset portion and the pins will engage a respective at least one channel or track to cause the offset portion to rotate.

Preferably, the intermediate member is moved by corresponding axial movement of the inner member relative to the outer member, the arrangement being such that movement of the inner member in a downwards direction will cause a bearing portion of the inner member to contact a corresponding bearing portion of the intermediate member, further downward movement of the inner member causing the intermediate member also to move in a downwards direction. Conveniently, at least one of the inner member and intermediate member comprises a bearing race for location therebetween, in order to allow the inner member to rotate relative to the intermediate member.

Conveniently, the intermediate member is biased in an upwards direction.

Preferably, when the intermediate member is moved downwards, the offset portion is rotated to offset the drill bit. Conversely, when the intermediate member is moved in an upwards direction, the offset portion is rotated to coaxially align the drill bit with the outer member.

Preferably, the inner member is provided in combination with an elongate member, such as a drive rod, which extends through at least a portion of the outer member. An upper portion of the inner member may be adapted for coupling to the drill string, with a lower portion of the inner member adapted for coupling to the drill bit, the elongate drive member rotatably coupling the lower portion of the inner member and the drill bit.

Conveniently, the drive member is flexible, to accommodate different relative orientations of the offset.

Preferably also, the drive member is axially moveable relative to at least one of the inner member and drill bit. The drive member and said at least one of the inner member and drill bit preferably define a cooperating profile to provide rotational coupling while permitting relative axial movement. For example, the drive member may have a hexagonal section, and the inner member or drill bit defines a cooperating hexagonal bore or bush.

Preferably, the inner member is coupled to the outer member by engagement of at least one pin mounted on one of the inner and outer members, with at least one complementary profiled path in the other of said inner and outer members. More preferably, the inner member is coupled to the outer member by engagement of at least one pin on the outer surface of the inner member with at least one complementary profiled path or track on an inner surface of the outer member. In a preferred embodiment, a plurality of pins are provided on the inner member which respectively engage complementary profiled paths in the outer member. Thus, by moving the inner member relative to the outer member, the at least one pin may be moved within the corresponding profiled path in order to reconfigure the drilling apparatus. Preferably, the apparatus is arranged such that, in the first configuration, the relative rotational orientation of the inner member and the outer member, including the offset portion, is known. This may be achieved by any appropriate mechanism, for example when pins or followers on one member engage paths or tracks on the other member, these may be arranged such that the pins or followers will only engage with a selected track or groove. In a preferred embodiment, one of the pins or followers may be longer than the others, and only a selected one of the paths or tracks may have a lead-in which will accommodate the longer pin.

This preferred arrangement offers the advantage that, in the first configuration, the relative orientation of the outer member, including the offset portion, to the inner member, and thus to the drill string, and the associated bottom hole assembly (BHA), will always be the same. As the BHA conventionally includes MWD apparatus, this existing MWD apparatus may be utilised to determine the orientation of the offset. Thus, the apparatus does not require the provision of dedicated MWD apparatus, or other orientation sensors, with a considerable saving in the costs of producing, using and maintaining the apparatus.

Preferably, in a third configuration, with weight applied to the apparatus, the gripping means is retracted and the drill bit is coaxially aligned with said portion of the outer member, and the inner member is coupled to the outer member such that rotation of the drill string provides for corresponding rotation of the inner and outer members, and the drill bit. The third configuration may thus be utilised for fixed trajectory or non-deviated rotary drilling. This arrangement is favourable as during fixed trajectory drilling the drill bit is coaxially aligned with the outer member, which eliminates the additional drilling forces and stresses which would otherwise be experienced by an offset drill bit rotating about an offset axis.

Preferably, the first configuration may be attained when the apparatus is lifted off bottom.

Preferably, the second configuration is attained with weight applied to the apparatus.

Preferably, the apparatus is adapted to move between configurations sequentially, in response to the application and lifting of weight to and from the apparatus. In a preferred embodiment, the apparatus may be cycled from the first configuration, to the second configuration, to the third configuration, and then to the first configuration.

The gripping means may take any appropriate form. Preferably, the gripping means are weight actuated, that is the gripping means extend and retract in response to weight being applied to or lifted from the apparatus. The gripping means may comprise radially movable members which engage movable cams or the like, but preferably comprise axially extending members which buckle or bow outwards on compression thereof. The members may carry ridges, teeth, or other profiles adapted to grip the bore wall to prevent rotation but to permit axial sliding. In other embodiments the gripping means may be fluid pressure actuated. Preferably, the gripping means is biased towards the retracted position.

According to a third aspect of the present invention, there is provided a directional drilling apparatus comprising first and second cooperating drill bit support members for mounting a drill bit to a drill string, the members being arranged such that, in a first configuration, a lateral axis of a drill bit supported by the members is substantially parallel with a lateral axis of a drill string on which the bit is mounted, and in a second configuration the drill bit axis is offset from the drill string axis.

Preferably, in the second configuration, the drill bit axis is offset at an angle from the drill string axis.

Conveniently, in the first configuration, a rotational axis of the drill bit is coaxially aligned with a rotational axis of the drill string, and in the second configuration, the rotational axis of the drill bit is offset at an angle from the rotational axis of the drill string.

In a preferred embodiment, the directional drilling apparatus is moved from the first to second configurations by rotation of the second drill bit support member relative to the first member. Advantageously, rotation of the second member is achieved in response to axial movement of the first member.

It should be noted that the term drill string used above should be understood to include any tubular or rotational member commonly found in a well bore environment. For example, the directional drilling apparatus may be utilised to mount a drill bit to drill pipe, drill collars, or tubular casing or liner or the like.

The directional drilling apparatus may be utilised in the manner as described above with reference to the second aspect. Alternatively, the directional drilling apparatus may be used in conjunction with any other appropriate drilling apparatus or Bottom Hole Assembly (BHA) for use in drilling a deviated bore.

The invention also relates to a method of directional drilling utilising the apparatus as described above with reference to the first to third aspects.

Those of skill in the art will also realise that some or all of the preferred features described above may be utilised to advantage in other forms of drilling apparatus, and are not restricted to use in combination with the abovementioned first aspect of the invention.

BRIEF DESCRIPTION OF THE DRAWINGS

These and other aspects of the invention will now be described, by way of example, with reference to the accompanying drawings, in which:

FIG. 11 is a perspective view of an offset portion of the apparatus of FIG. 8;

FIG. 12*a* shows a side cross-sectional view of the apparatus of FIG. 8; and FIG. 12*b* shows an enlarged front cross-sectional view on a line C-C of FIG. 12*a*.

DETAILED DESCRIPTION OF THE DRAWINGS

Figure 1:
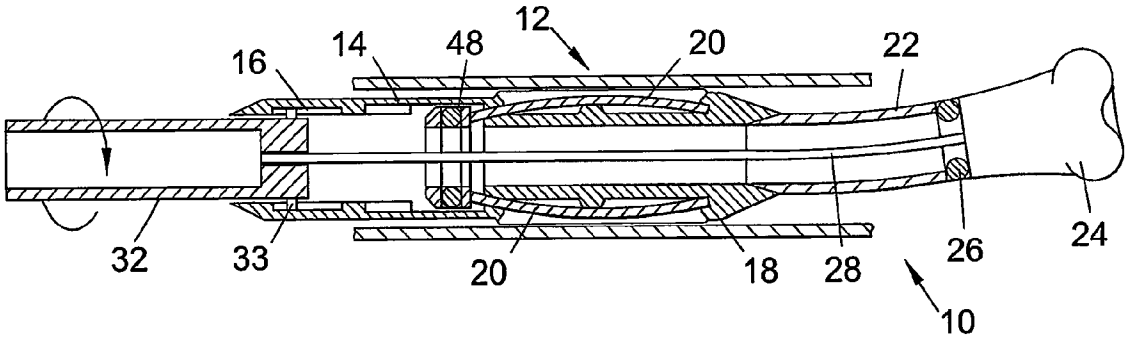
FIG. 1 is a schematic sectional view of drilling apparatus in accordance with a preferred embodiment of a first aspect of the present invention, shown in a first configuration.
Figure 2:
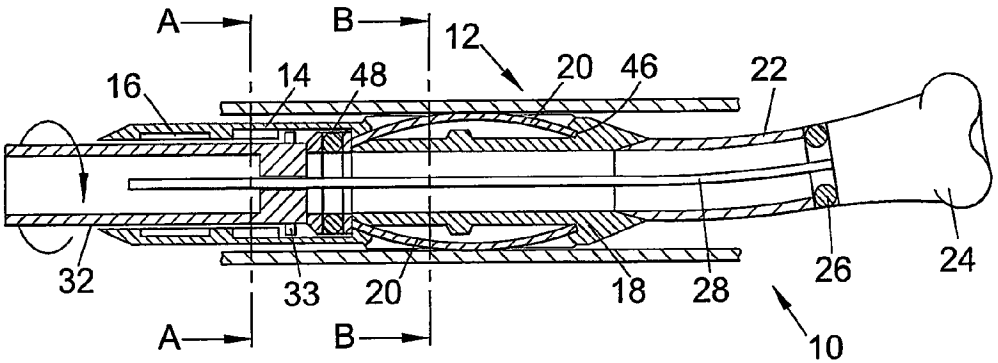
FIG. 2 shows the drilling apparatus of FIG. 1 in a second configuration.
Figure 3:
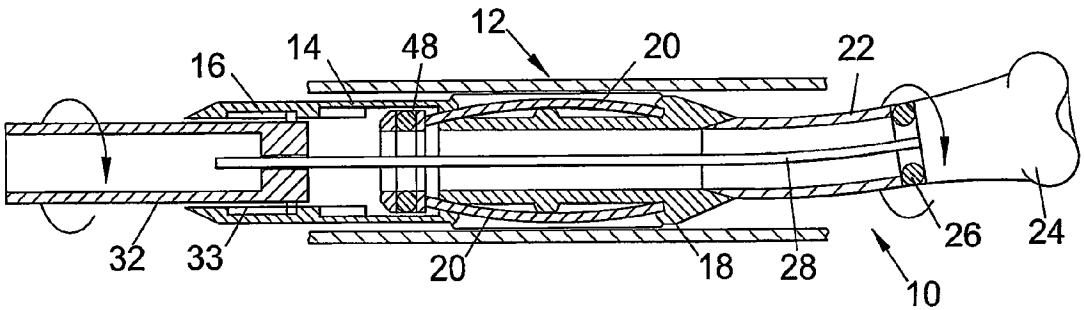
FIG. 3 shows the drilling apparatus of FIG. 1 in a third configuration.

Reference is first made to FIGS. 1 to 3 of the drawings which illustrate a drilling apparatus 10 for drilling a deviated bore, in accordance with one embodiment of the present invention.

The apparatus comprises a tubular outer member 12 comprising an upper sleeve 14 defining a plurality of inner tracks 16, a tubular body 18 carrying a plurality of spring grippers 20, and a leading bent sub 22 defining an offset. Those of skill in the art will recognise that the offset is exaggerated in the Figures; in practice, the offset is typically around 1 degree. The sub 22 provides a rotatable mounting for a drill bit 24, via bearing 26. The bit 24 is rotatably coupled to the end of a flexible hexagonal drive rod 28. The drive rod 28 extends upwardly, through the bent sub 22 and body 18, and is rotatably coupled to an inner member 32, the lower end of the member 32 being located within the outer upper sleeve 14 and provided with studs 33 for engaging respective tracks 16 in the sleeve 14. The upper end of the member 32 is coupled to the drill string (not shown).

In a first configuration, as illustrated in FIG. 1 of the drawings, the grippers 20 are radially retracted, and in use will describe a diameter less than the inner diameter of the bore being drilled. The outer and inner members 12, 32 are rotatably coupled, such that rotation of the drill string from surface causes the entire apparatus 10 to rotate in unison. As will be described, the relative orientation of the coupled members 12, 32 is known, such that by monitoring the output of the MWD apparatus provided in the bottom hole assembly (BHA) of the drill string above the apparatus 10, which MWD apparatus will indicate, among other things, the orientation of the BHA, the orientation of the bent sub 22 may be determined. Thus, by rotating the string from surface, a desired and readily determined bent sub orientation may be achieved.

Once the bent sub 22 has been orientated as desired, the apparatus 10 is reconfigured, to the second configuration, as illustrated in FIG. 2, to retain the selected orientation and to drill in the resulting selected direction. As will subsequently be described in greater detail, reconfiguring the apparatus 10 radially extends the grippers 20 to engage the surrounding wall, while disengaging the outer and inner members 12, 32 such that the inner member 32 may be rotated in the bore while the outer member 12 does not rotate. The orientation of the bent sub 22 is therefore retained while the drill bit 24 may be rotated from surface, via the inner member 32.

For drilling straight ahead, the apparatus 10 is arranged in a third configuration, as illustrated in FIG. 3 of the drawings. In this configuration, the grippers 20 are retracted and the outer and inner members 12, 32 are rotationally coupled. Thus, rotation of the bit 24 is accompanied by rotation of the outer member 12, including the bent sub 22, such that the effect of the bent sub 22 is negated.

The construction and operation of the apparatus will now be described in greater detail, with reference also to FIGS. 4 to 7 of the drawings.

Reconfiguring the apparatus 10 is achieved simply by the sequential application of weight to the apparatus 10 and then lifting the bit 24 off bottom, such that a tension is applied to the apparatus 10.

Figure 4:
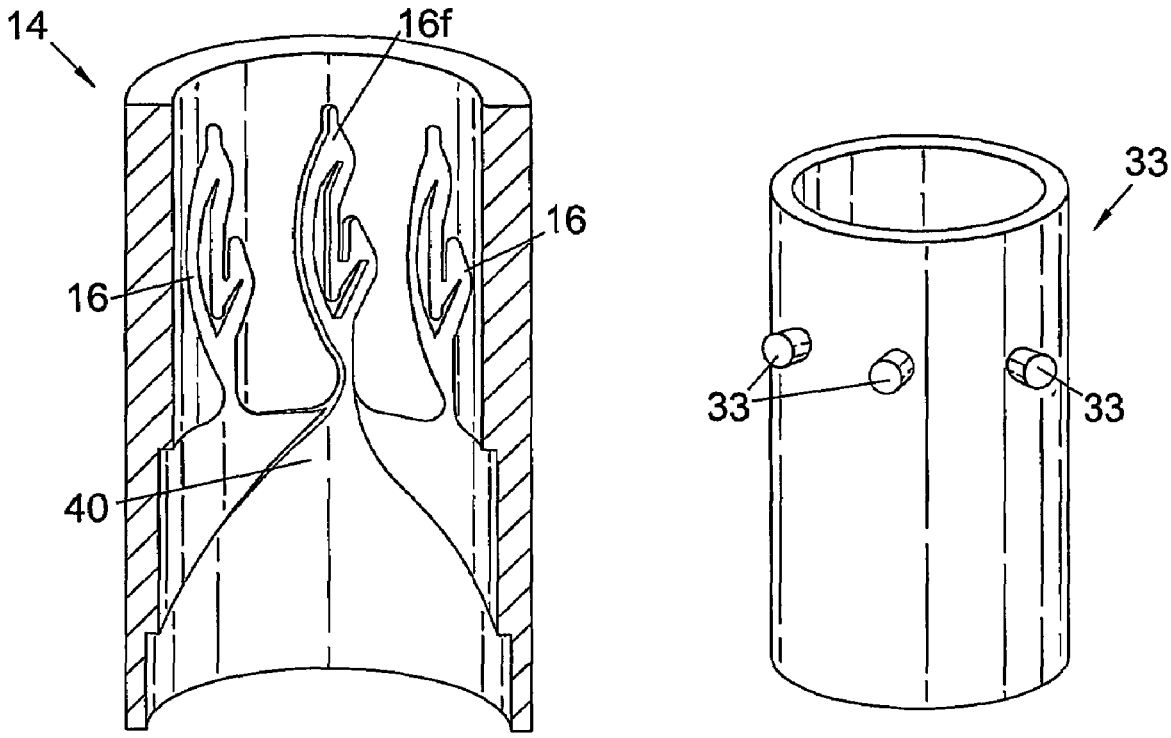
FIG. 4 is an enlarged perspective view of parts of an outer member and an inner member of the apparatus of FIG. 1, showing tracks defined by the outer member and track following pins mounted on the inner member.
Figure 5:
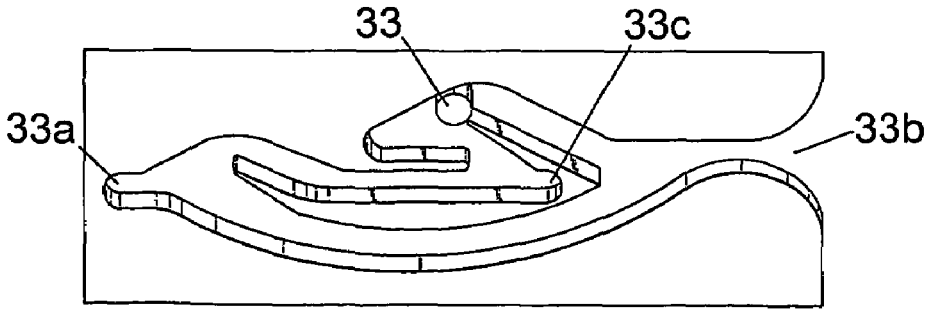
FIG. 5 is an enlarged view of one of the tracks provided in the outer member of FIG. 4.

FIGS. 4 and 5 illustrate the tracks 16 which are machined into the inner face of the upper sleeve 14, and the studs 33 which are arranged to move in an anti-clockwise direction around the tracks 16 as the apparatus is cycled between configurations. With reference to FIG. 5, the stud positions 33*a*, 33*b* and 33*c* correspond to the first, second and third configurations shown in FIGS. 1, 2 and 3, respectively.

Figure 6:
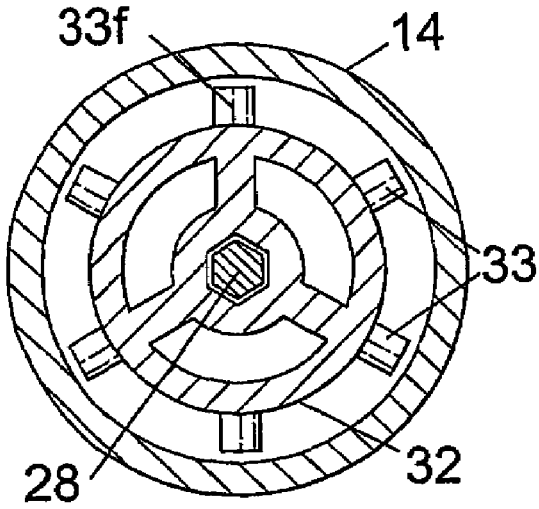
FIG. 6 is a sectional view on line A-A of FIG. 2.

One of the six studs 33*f* is longer than the others, as is visible in FIG. 6 of the drawings which is a sectional view of FIG. 2 through A-A. This stud 33*f* cooperates with a deeper cut track 16*f* (FIG. 4) having a flared lead-in 40, such that the longer stud 33*f* can only be located in the deeper track. Thus, when the outer and inner members 12, 32 are rotatably coupled, the relative rotational positions of the members 12, 32 are known.

Figure 7:
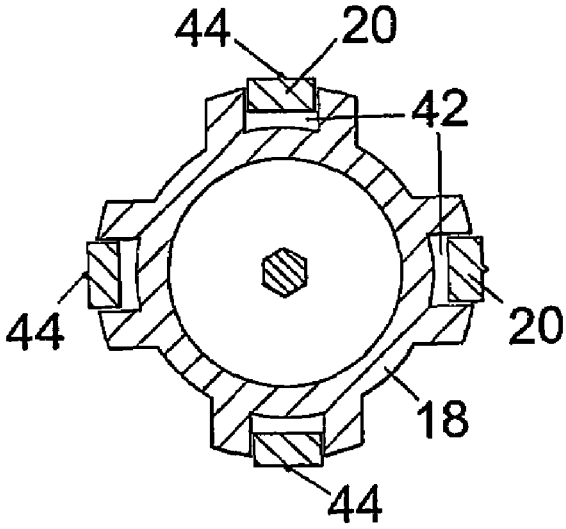
FIG. 7 is a sectional view on line B-B of FIG. 2.

Reference is now made in particular to FIG. 7 of the drawings, which is a sectional view through B-B of FIG. 2 showing the spring grippers 20 in their extended configuration, extending radially beyond gripper locating slots 42 in the body 18. The grippers 20 are in the form of axially extending rectangular bands and each carries an axial ridge 44 to grip the bore wall to prevent rotation while permitting axial movement. From FIG. 2 it will be noted that the lower end of each gripper 20 is retained in a slot 46 in the body 18, while the upper end of each gripper 20 is attached too a bearing race 48 located between the upper end of the body 18 and the lower end of upper sleeve 14.

When the apparatus 10 is in the second configuration, the lower end of the inner member 32 contacts and moves the bearing race 48 down towards the upper end of the body 18, causing the grippers 20 to bow outwards to engage and grip the bore wall. In the first and third positions, the bearing race 48 is free to move upwards under the return force of the gripper bands 20.

For normal drilling of a bore straight ahead, the apparatus 10 is maintained in the second configuration (FIG. 2), with the studs 33 in the position 33*b* (FIG. 5). Weight applied from surface, or from the mass of the drill string above the apparatus, is transmitted to the bit 24 from the inner member 32 to the outer sleeve 14 via the studs 33, and through the body 18 and the bent sub 22.

The inner member 32 is prevented from coming into contact with the bearing race 48 as axial movement of the member 32 is restrained by the studs 33 engaging with the tracks 16, such that the grippers 20 remain retracted. Thus, the apparatus 10 rotates as one with the drill string, the rotation of the bent sub 22 negating the effect of the offset.

If it is desired to deviate the bore in a particular direction, rotation of the string is stopped, and the string lifted from bottom, such that studs 33 travel up the respective tracks 16 to position 33*a* (FIG. 5), the inner member 32 sliding upwardly over the drive rod 28. The apparatus 10 is now in the first configuration as shown in FIG. 1. The inner member 32 remains rotatably coupled to the outer sleeve 14, such that rotation of the string causes the apparatus, including the bent sub 22, to rotate in the bore.

By monitoring the MWD of the BHA, the bent sub 22 may be postponed in a desired orientation, to achieve the desired deviation of the bore.

If weight is then applied to the apparatus 10, the studs 33 move down the tracks 16 beyond the lower ends of the tracks 16, to position 33*b*, such that the apparatus is in the second configuration (FIG. 2).

In this configuration, the studs 33 are clear of the tracks 16 and thus the inner member 32 may rotate without causing corresponding rotation of the outer sleeve 14, drive rod 28 transferring rotation from the member 32 to the drill bit 24. The lower end of the inner member 32 engages the bearing race 48, causing the grippers 20 to buckle outwardly into contact with the bore wall, preventing the outer member 12 from rotating.

Thus, in this configuration, when the drill string is rotated, the outer member 12 does not rotate, while the bit 24 is rotated and advances the bore in the direction of selected orientation of the bent sub 22.

When the orientation of the BHA, and thus the bore, as measured by the MWD apparatus, has changed to that desired by the driller, rotation of the drill string is halted. The drill string is then lifted, and then weight applied once more to locate the studs 33 in the position 33*c*. The bore may then be drilled on, maintained to previously attained bore orientation.

Figure 8:
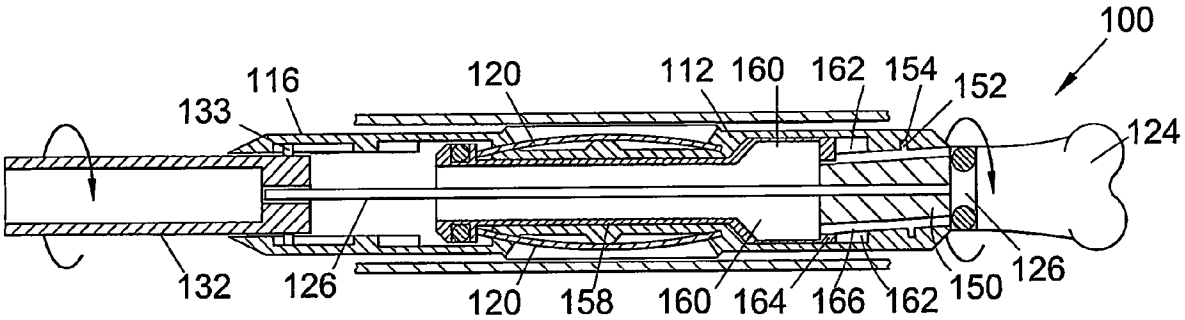
FIG. 8 is a schematic sectional view of a drilling apparatus in accordance with a preferred embodiment of a second aspect of the present invention, shown in a first configuration.
Figure 9:
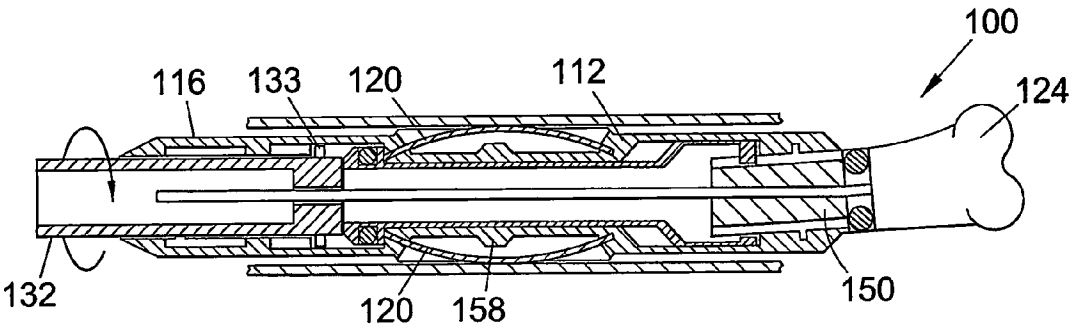
FIG. 9 shows the drilling apparatus of FIG. 8 in a second configuration.
Figure 10:
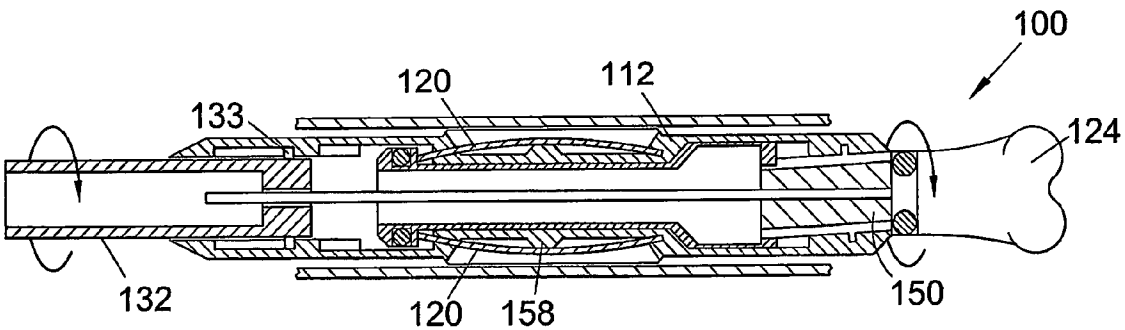
FIG. 10 shows the drilling apparatus of FIG. 8 in a third configuration.

Reference is now made to FIGS. 8 to 10 of the drawings in which there is shown a drilling apparatus 100 for drilling a deviated bore, in accordance with an alternative embodiment of the present invention. It should be noted that the apparatus 100 is similar to that apparatus 10 shown in FIGS. 1 to 7, and as such like components share the same reference numerals, preceded by a "1".

The apparatus 100 comprises a tubular outer member 112 having an upper portion defining a number of tracks 116 and including a plurality of spring grippers 120. Rotatably mounted within a lower portion of the outer member 112 is an offset portion 150, which portion 150 has an axis of rotation disposed at an angle from an axis of rotation of the outer member 112. The offset portion 150 is axially fixed relative to the outer member by way of an annular collar 152 mounted on the outer surface of the offset portion 150 engaging an annular recess 154 in the inner surface of the outer member 112.

A drill bit 124 is rotatably located on an end face 156 of the offset portion 150 via bearing 126. The face 156 upon which the drill bit 124 is located is inclined from a lateral axis of the offset portion 150, which feature is used in offsetting the drill bit 124 to effect directional drilling, as will be described in more detail below.

The drill bit 126 is rotatably coupled to the end of a flexible drive rod 128 which extends upwardly through the outer member 112 and is rotatably coupled to an inner member 132. The lower end of the member 132 is located within the upper portion of the outer member 112 and is provided with studs 133 for engaging respective tracks 116 in the outer member 112. The interaction of the pins 133 with the tracks 116 allows the apparatus 100 to be reconfigured in the same manner as described above with reference to FIGS. 4 to 6. The upper end of the inner member 132 is coupled to the drill string (not shown).

The apparatus further comprises an intermediate tubular member 158 located between the inner member 132 and the offset portion 150. The intermediate tubular member 158 is axially moveable and rotationally fixed with respect to the outer member 112 by engagement of diametrically opposed key portions 160 on the intermediate member 158 with respective longitudinal key-ways 162. In use, axial movement of the intermediate member 158 is translated to rotational movement of the offset portion 150 in order to orientate the drill bit 124 in the required direction. Axial movement of the intermediate tubular member 158 is translated to rotational movement of the offset portion 150 by interaction of a plurality of pins 164 mounted on the inner surface of the intermediate member 158 with respective helical tracks 166 in the outer surface of the offset portion 150. The form of the tracks 166 is more clearly shown in FIG. 11, which is a perspective view of the offset portion 150. Also shown in FIG. 11 is the annular collar 152 which, in conjunction with the annular recess 154 in the outer member 112, shown in FIG. 8 to 10, prevents the offset portion 150 from moving in an axial direction with respect to the outer member 112. A clearer view of the interaction between the outer and intermediate members 112, 158 and the offset portion 150 is shown in FIGS. 12*a* and *b*, with a corresponding description given hereinafter.

The intermediate tubular member 158 moves the offset portion 150 between first and second rotational positions. In the embodiment shown, the offset portion 150 is moved from the first to the second position by movement of the intermediate member 158 in a downwards direction, and vice versa. In the first position, shown in FIG. 8, the inclination of the end face 156 of the offset portion 150 is negated by the offset of the axis of rotation, resulting in the end face 156 being positioned substantially parallel to an end face of the outer member 112, and the drill bit 124 being coaxially aligned with the outer member 112. In the second position, shown in FIG. 9, the effect of the inclination of the end face 156 in combination with the angle of offset results in the end face 156 being inclined relative to the end face of the outer member 112. Thus, when the offset portion 150 is in the second position, the drill bit 124 is coaxially misaligned or offset.

In a first configuration, as illustrated in FIG. 8 of the drawings, the grippers 120 are radially retracted and the outer and inner members 112, 132 are rotatably coupled, such that rotation of the drill string from surface causes the entire apparatus 100 to rotate in unison. As described above with reference to the first embodiment of the invention, it is possible to determine the relative orientation of the rotary coupled members 112, 132 such that a desired and readily determined initial orientation of the offset portion 150 may be achieved. It should be noted that in the first configuration, no weight is applied to the apparatus 100 from the drill string.

Once the desired initial orientation of the offset member 150 is achieved, the apparatus 100 is reconfigured to a second configuration, shown in FIG. 9, wherein the drill bit 124 is coaxially misaligned, to a predetermined extent and in a predetermined direction by rotation of the offset portion 150 relative to the outer member 112, and the grippers 120 are radially extended to engage the surrounding wall to prevent rotation of the outer member 112, and thus maintain the desired, final offset of the drill bit 124. Additionally, in the second configuration, the inner member 132 is disengaged from the outer member 112 such that the inner member 132 may be rotated in the bore while the outer member 112 does not rotate. The orientation of the drill bit 124 is therefore retained while the drill bit 124 may be rotated from surface.

As noted hereinbefore, the offset member 150 is rotated to orientate the drill bit 124 by corresponding axial movement of the intermediate member 158. Axial movement of the intermediate member 158 is achieved in response to axial movement of the inner member 132, the arrangement being such that movement of the inner member 132 in a downwards direction will cause a bearing portion of the inner member 132 to contact a corresponding bearing portion of the intermediate member 158, further downward movement of the inner member 132 causing the intermediate member 158 also to move in a downwards direction. Positioned on the intermediate member 158 is a bearing race 168 which allows the inner member 132 to rotate relative to the intermediate member 158 when the apparatus 100 is in the second configuration and also provides a weight transfer point from the drill string to the drill bit 124.

If fixed trajectory or non-deviated drilling is required, the apparatus 100 may be reconfigured into a third configuration, as shown in FIG. 10 of the drawings. In this configuration, the grippers 120 are retracted and the outer and inner members 112, 132 are rotationally coupled, and weight is applied to the apparatus 100 by the drilling string via pins 133 on the inner member 132. The offset portion 150 is located in its first position by movement of the intermediate member 158 in an upwards direction such that the drill bit 124 is coaxially aligned with the outer member 112. The intermediate member 158 is biased towards movement in an upwards direction under the return force of the gripper bands 120. Thus, when the inner member 132 is lifted from the bearing 168 of the intermediate member 158, the intermediate member 158 will move in an upwards direction due to the retraction of the grippers 120. It should be noted that the gripper bands 120 of the current embodiment are similar to those as described with reference to FIG. 7, and thus no further description will be given. Thus, by action of the intermediate member 158, the offset portion 150 is biased towards its first rotational position wherein the drill bit 124 is coaxially aligned. The arrangement of having the drill bit 124 coaxially aligned in the third configuration of the apparatus during fixed trajectory drilling is particularly advantageous as the additional drilling forces and stresses on the apparatus which would otherwise be experienced by use of an offset drill bit are eliminated.

A more detailed view of the interaction of the offset portion 150, intermediate member 158 and outer member 112 is shown in FIGS. 12*a* and *b*, which respectively show an enlarged side view and corresponding cross-sectional view, through C-C of FIG. 12*a*, of the apparatus 100. As discussed above, the intermediate member 158 is axially moveable and rotationally fixed with respect to the outer member 112 by diametrically disposed, longitudinal sliding key 160 and key-way 162 arrangements. The intermediate member 158 comprises a plurality of pins 164 which engage respective helical tracks 166 in the offset portion 150 to effect rotational movement thereof, and therefore position the drill bit 124 in its desired orientation.

It will thus be appreciated that the apparatuses 10, 100 provide relatively simple and robust arrangements for permitting rotary directional drilling.

It will of course be appreciated by those of skill in the art that the above described example is merely exemplary of the present invention, and that various modifications and improvements may be made thereto, without departing from the scope of the invention. For example, the drive rod 28 may be hollow, to allow objects and tools, such as logging tools, to be run in through the apparatus. In certain embodiments, such a hollow drive rod may be utilised together with a drill bit having a removable portion, to permit "through-the-bit-logging". Such an arrangement is described in U.S. Pat. No. 6,269,891 which relates to a system and method of drilling and logging an earth formation.

The invention claimed is:

1. A drilling apparatus for drilling a deviated bore, said apparatus comprising:

a tubular outer member having gripping means for selectively engaging the wall of a bore to restrain the member against rotation and including an offset portion for rotatably supporting a drill bit;

an inner member located within the outer member and for coupling to the drill bit at one end and to a drill string at another end;

wherein the apparatus has a first configuration in which the gripping means is retracted and the inner member is coupled to the outer member such that rotation of the drill string provides for corresponding rotation of the inner and outer members, and a second configuration in which the gripping means is extended and the inner member is rotatable relative to the outer member such that the outer member is restrained from rotation in the bore and rotation of the drill string provides for corresponding rotation of the inner member and the drill bit, and wherein the inner member is moveable in at least one of an axial and rotatable direction relative to the outer member to reconfigure the apparatus.

2. A drilling apparatus as claimed in claim 1, wherein the offset portion is rotatably mounted within a portion of the outer member and is rotatable relative thereto between a first position and a second position.

3. A drilling apparatus as claimed in claim 2, wherein the offset portion is axially fixed relative to said portion of the outer member.

4. A drilling apparatus as claimed in claim 1, wherein rotation of the offset portion between said first and second positions occurs in response to axial movement of the inner member with respect to said portion of the outer member.

5. A drilling apparatus as claimed in claim 1, wherein the offset portion has an axis of rotation disposed at an angle from an axis of rotation of said portion of the outer member.

6. A drilling apparatus as claimed in claim 2, wherein the drill bit is rotatably located relative to a lower end face of the offset portion, which lower end face is inclined from a lateral axis of the offset portion such that, in the first rotational position, the inclination of the end face is negated by the angle of offset of the axis of rotation, resulting in the end face of the offset portion being positioned substantially parallel to an end face of said portion of the outer member.

7. A drilling apparatus as claimed in claim 6, wherein, in the second rotational position, the effect of the inclination of the end face in combination with the angle of offset of the rotational axis of the offset portion results in the end face of the offset portion being inclined relative to the end face of said portion of the outer member.

8. A drilling apparatus as claimed in claim 2, wherein, when the offset portion is in a first rotational position, the drill bit will be coaxially aligned with said portion of the outer member, and when the offset portion is in a second position, the drill bit will be coaxially misaligned.

9. A drilling apparatus as claimed in claim 2, wherein, in the first configuration of the apparatus, the drill bit is coaxially aligned with said portion of the outer member, and in the second configuration, the drill bit is coaxially misaligned.

10. A drilling apparatus as claimed in claim 1, wherein the inner member includes an elongate drive member which extends through at least a portion of the outer member.

11. A drilling apparatus as claimed in claim 10, wherein an upper portion of the inner member is adapted for coupling to the drill string, with a lower portion of the inner member adapted for coupling to the drill bit, the elongate drive member rotatably coupling the lower portion of the inner member and the drill bit.

12. A drilling apparatus as claimed in claim 10, wherein the drive member is flexible, to accommodate different relative orientations of the offset.

13. A drilling apparatus as claimed in claim 10, wherein the drive member is axially moveable relative to at least one of the lower portion of the inner member and drill bit.

14. A drilling apparatus as claimed in claim 10, wherein the drive member and at least one of the inner member and drill bit define a cooperating profile to provide rotational coupling while permitting relative axial movement.

15. A drilling apparatus as claimed in claim 14, wherein the drive member has a hexagonal section, and the inner member or drill bit defines a cooperating hexagonal bore.

16. A drilling apparatus as claimed in claim 1, wherein the inner member is coupled to the outer member by engagement of at least one pin mounted on one of the inner and outer members, with at least one complementary profiled path in the other of said inner and outer members.

17. A drilling apparatus as claimed in claim 1, wherein the inner member is coupled to the outer member by engagement of at least one pin on the outer surface of the inner member with at least one complementary profiled path or track on an inner surface of the outer member.

18. A drilling apparatus as claimed in claim 1, wherein the apparatus is arranged such that in a first configuration, the relative rotational orientation of the inner and outer members is predetermined.

19. A drilling apparatus as claimed in claim 1, wherein the first configuration may be attained when the apparatus is lifted off bottom.

20. A drilling apparatus as claimed in claim 1, wherein the second configuration is attained with weight applied to the apparatus.

21. A drilling apparatus as claimed in claim 1, wherein the apparatus is adapted to move between configurations sequentially, in response to the application and lifting of weight to and from the apparatus.

22. A drilling apparatus as claimed in claim 1, wherein the gripping means are weight actuated such that the gripping means is extended and retract in response to weight being applied to or lifted from the apparatus.

23. A drilling apparatus as claimed in claim 1, wherein the gripping means comprises radially moveable members.

24. A drilling apparatus as claimed in claim 1, wherein the gripping means is biased towards the retracted position.

25. A method of directional drilling utilising the apparatus as described in claim 1.

* * * * *